United States Patent [19]

Reindel

[11] Patent Number: 4,905,013

[45] Date of Patent: Feb. 27, 1990

[54] FIN-LINE HORN ANTENNA

[75] Inventor: John Reindel, San Diego, Calif.

[73] Assignee: United States of America as represented by the Secretary of the Navy, Washington, D.C.

[21] Appl. No.: 147,970

[22] Filed: Jan. 25, 1988

[51] Int. Cl.[4] ..... H01Q 13/00

[52] U.S. Cl. ..... 343/786; 343/795; 343/807; 333/21 A

[58] Field of Search ..... 343/786, 792, 795, 807; 333/21 A, 33

[56] References Cited

U.S. PATENT DOCUMENTS

| | | | |
|---|---|---|---|
| 2,946,055 | 7/1960 | Faflick | 343/727 |
| 3,623,112 | 11/1971 | Rupp | 343/727 |
| 4,001,834 | 1/1977 | Smith | 343/795 |
| 4,063,248 | 12/1977 | Debski et al. | 343/727 |
| 4,157,516 | 6/1979 | Van De Grijp | 333/26 |
| 4,298,878 | 11/1981 | Dupressoir et al. | 343/795 |
| 4,425,549 | 1/1984 | Schwartz et al. | 333/239 |
| 4,500,887 | 2/1985 | Nester | 343/795 |
| 4,502,053 | 2/1985 | Dupressoir et al. | 343/795 |
| 4,573,056 | 2/1986 | Dudome et al. | 343/795 |
| 4,673,897 | 6/1987 | Chua et al. | 333/21 A |

FOREIGN PATENT DOCUMENTS

| | | | |
|---|---|---|---|
| 2490025 | 3/1982 | France | 343/786 |

*Primary Examiner*—William L. Sikes
*Assistant Examiner*—Hoanganh Le
*Attorney, Agent, or Firm*—Harvey Fendelman; Thomas Glenn Keough

[57] ABSTRACT

A fin line circuit card containing a fin line slot feeds a dipole antenna which extends a quarterwave outside the waveguide and provides an energy beam focal point at or near the open end of the waveguide. The dipole antenna thus maintains a wide and nearly constant beamwidth, low VSWR and a circular symmetric radiation pattern for use in electronic warfare direction finding and surveillance applications.

14 Claims, 2 Drawing Sheets

FIN-LINE HORN ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the fields of waveguides, antennas and millimeter wave devices. More specifically, the present invention relates to millimeter wave antennas and especially to those antennas suitable for use in electronic warfare direction finding and surveillance applications.

Waveguide horns are excellent radiators at the millimeter wave frequencies. They can be designed to achieve good circular symmetry and low voltage standing wave ratios (VSWR). In order to achieve broad beamwidth the waveguide horns must have small openings or apertures. This is due to the fact that the focal point of the radiating beam is behind the rim of the horns or within the waveguide itself. The smallest horn with the broadest beam is achieved by use of an open ended waveguide. Open ended waveguides have a beamwidth of 70 to 55 degrees as a function of the frequency over the normal waveguide bandwidth.

Surveillance systems that obtain the angle of arrival by means of amplitude comparison from four antennas disposed in quadrature, i.e. pointing 90 degrees apart, require antenna beams that ideally have 90 degree widths and little or no variations in beamwidth over the desired bandwidth. Smaller beamwidths and variations can be tolerated but will degrade the accuracy and sensitivity of the receiving system. Efforts to broaden the beam by means of dielectric lenses have been attempted but have not been satisfactory due to the variations in beamwidth with frequency and to losses associated with the dielectric.

SUMMARY OF THE INVENTION

The present invention comprises a waveguide/antenna assembly that achieves a nearly constant 90 degree beamwidth in the frequency range of the normal waveguide band. It has a good VSWR and circularity. Further, the antenna assembly of the present invention is comprised of a miniaturized antenna that may be manufactured for little cost and that is particularly suitable for use in electronic warfare direction finding and surveillance applications.

The antenna assembly of the present invention is comprised of a fin-line dipole radiator that extends outside an open ended waveguide by a quarter wavelength. The dipole radiator is a planar configuration and is formed on the fin-line circuit card. Electromagnetic energy propagation between the dipole radiator and the waveguide is achieved via a fin-line slot formed on the fin-line circuit card. By using this dipole antenna structure and feed arrangement integration with millimeter wave receiving circuits is facilitated because the fin-line impedance is low and well matched to diode beam-lead circuits or the like.

The present invention achieves the broad beamwidth pattern by focusing the antenna beam from a point outside the waveguide opening and therefore provides a broader beam than possible by using the waveguide horn or waveguide opening alone. In accordance with the present invention the tendency to broaden the beam with frequency counters the tendency of the horn characteristics such that the present invention can be used over a broad frequency range while maintaining a nearly constant beam shape.

OBJECTS OF THE INVENTION

Accordingly, it is the primary object of the present invention to disclose a millimeter wave antenna that provides a relatively constant antenna beam pattern with a near 90 degree beamwidth over a large frequency band.

It is a further object of the present invention to disclose a waveguide/antenna assembly that has a low VSWR and a circular symmetric radiation pattern and that is small and inexpensive.

These and other objects of the invention will become more readily apparent from the ensuing specification and claims when taken in conjunction with the attached drawings.

DESCRIPTION OF THE PREFERRED EMBODIMENT

Figure 1:
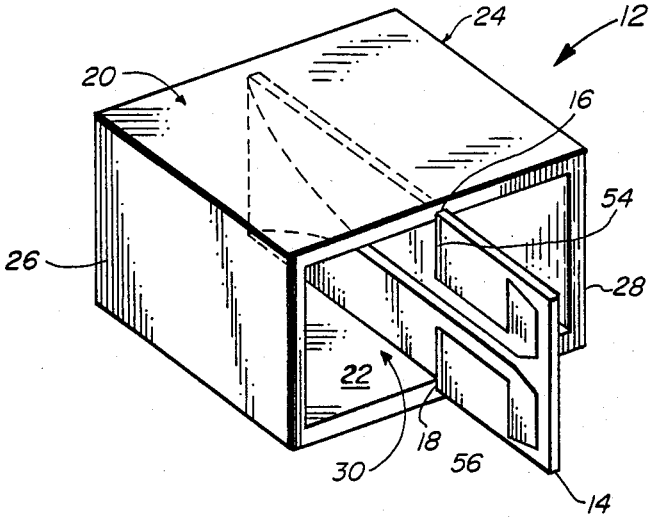
FIG. 1 is an isometric view of the waveguide/antenna assembly of the present invention.

Referring to FIG. 1 the antenna assembly 12 of the present invention is illustrated and will be described. The antenna assembly 12 is comprised of a fin-line circuit card 14 that is fitted within grooves 16 and 18 which are formed in the center of the two broadwalls 20 and 22, respectively of rectangular waveguide 24. The circuit board 14 is positioned within the waveguide 24 such that its plane is orthogonal to waveguide broadwalls 20 and 22 and, therefore, parallel to waveguide broadwalls 26 and 28. Further, the circuit board 14 is positioned such that it extends or protrudes from the waveguide opening 30 as is illustrated in FIG. 1.

Figure 2:
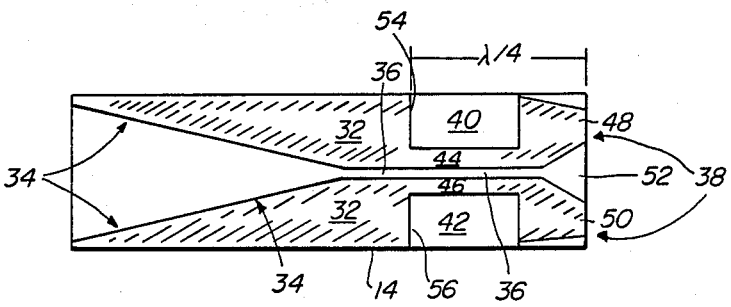
FIG. 2 is a top view of the fin-line circuit board and conductive pattern formed thereon in accordance with the present invention.

Referring now collectively to FIGS. 1 and 2 the circuit card 14 and the circuit formed thereon will be described. The circuit that is formed on circuit card 14 is formed in a conductive layer 32 that is disposed on at least one surface of the circuit card 14. The conductive layer 32 is preferably made of copper that is deposited on the dielectric card 14 by well known techniques. The conductive layer 32 may have a transition 34 that in the present example is comprised of tapered dual ridge conducting surfaces that match the input impedance of the waveguide to which waveguide section 24 is connected to that of the fin-line slot 36 that is formed within metal layer 32. By using transitions such as transition 34 the slot line 36 can be matched to a low impedance dielectric loaded dual ridge waveguide (not shown). However, integrated receivers may omit such transitions because the millimeter wave converter or detector circuits generally require low impedance lines for matching to mixer or detector diodes. Hence, the transition would not be needed or used if the antenna slot line feed 36 were used to feed directly into an appropriate diode circuit.

The low impedance balanced transmission line, i.e. slot line 36 is fed to a dipole radiator 38 that is formed by removing the metal surfaces in regions 40 and 42 from the conductive layer 32 on fin-line circuit card 14. By so removing the metal from regions 40 and 42 the metal layer 32 that boarders the slot-line 36, a pair of parallel conducting co-planar strips 44 and 46 are formed which feed the dipole radiators 38. The regions 40 may have quadrangular shapes, rectangular shapes or triangular shapes or other configurations as needed to obtain the most desirable antenna radiation performance.

The dipole radiators 38 are comprised of metallic regions or pads 48 and 50 which in the embodiment illustrated in FIG. 2 are generally quadrangular in shape. A slot 52 between the pads 48 and 50 is generally horn shaped and tapered such that the distance between the pads 48 and 50 increases as the distance along the longitudinal axis through the slot-line 36 increases away from the waveguide opening 30.

Referring to FIG. 1 it can be seen that the metallic layer 32 is in electrical contact with the broadwalls 20 and 22 and it can be seen that the inner edges 54 and 56 of metallically void regions 40 and 42 are aligned with the edge of waveguide opening 30. Further, as is shown in FIG. 2 the dipole radiators 38 extend for a distance of approximately one-quarter wavelength, i.e. $\lambda/4$, where $\lambda$ is the wavelength at the midband of the operating frequency of the antenna.

Figure 4:
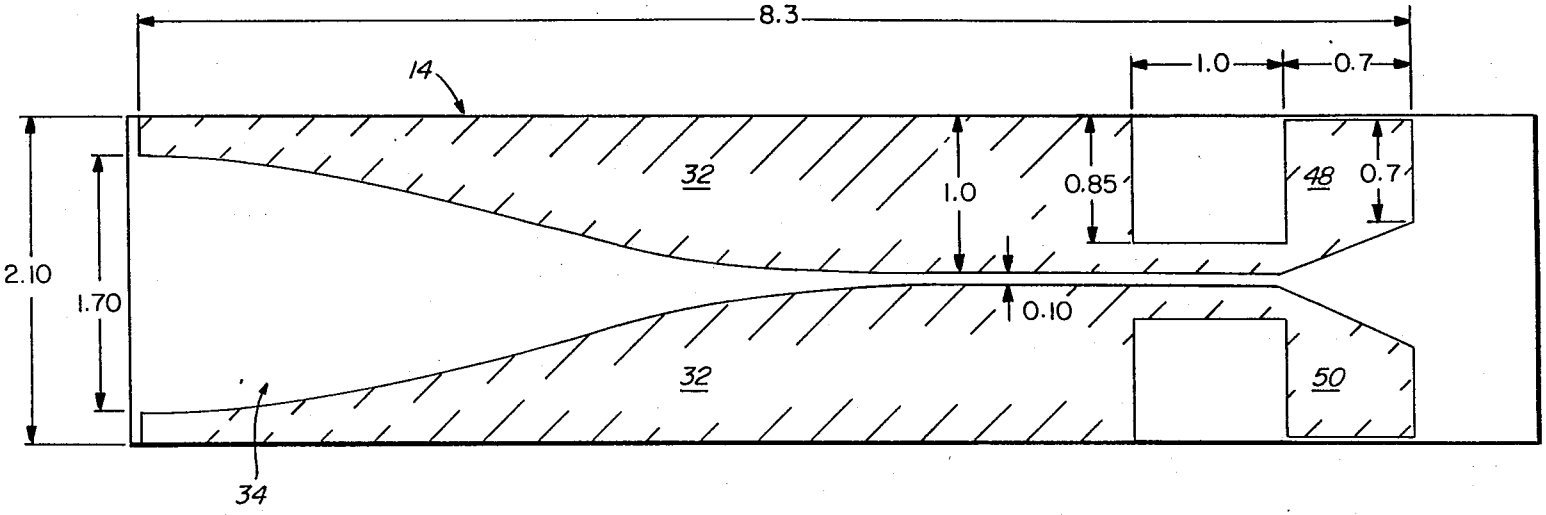
FIG. 4 is a top view of the circuit card of the present invention showing, by way of example, suitable dimensions for the Ka band.

Other dimensions given by way of example for device in accordance with the present invention intended to operate in the Ka band frequency range are illustrated in FIG. 4, all dimensions being in inches.

Figure 3:
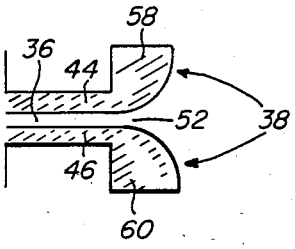
FIG. 3 is a schematic illustration of alternative dipole radiator shapes in accordance with the present invention.

As alternate embodiments to the embodiment of the present invention illustrated in FIGS. 1 and 2 it is within the scope of the present invention that the shape of pads 48 and 50 may be other than generally quadrangular. For instance, the dipole radiators 38 could be comprised of curve linear or crescent shape pads 58 and 60 as is illustrated in FIG. 3. Further, other shapes other than those illustrated in FIGS. 1, 2 and 3 for the dipole radiators 38 could be utilized in accordance with the present invention. Whatever shapes are utilized, however, it is believed that it remains desirable to utilize a horn-shape separation 52 between the radiator elements 38 or some other tapered or gradually increasing separation between the dipole element in order to broaden the frequency characteristics of the radiator and to match the dipole impedance to the impedance of free space.

As a further alternative embodiment to the present invention both sides of dielectric card 14 could be provided with identical, congruent metallic surfaces instead of providing metallic surfaces merely on one side of the dielectric card as is illustrated in FIG. 2.

Obviously, many modifications and variations of the present invention are possible in the light of the above teachings. It is therefore to be understood that within the scope of the appended claims the invention may be practiced otherwise than as specifically described.

I claim:

1. A fin-line horn antenna assembly comprising:

a waveguide horn having a longitudinal axis and having an open end for radiating and receiving electromagnetic energy;

a planar, dielectric card positioned within said waveguide, the plane of said card being parallel to said longitudinal axis;

a layer of conductive material disposed on a surface of said card;

a fin-line slot for propagating electromagnetic energy, formed in said layer of conductive material;

a dipole radiator formed on said dielectric card and coupled to said fin-line slot for propagating electromagnetic energy therebetween; and energy transition means formed on said dielectric card and operably coupled to said fin-line slot for providing coupling of electromagnetic energy from said waveguide to said fin-line slot.

2. The antenna assembly of claim 1 wherein:

said waveguide is a rectangular waveguide having first and second broadwalls and first and second narrow walls; and wherein said dielectric card is positioned orthogonal to said first and second broadwalls.

3. The antenna assembly of claim 2 wherein:

said layer of conductive material is in electrical contact with said first and second broadwalls.

4. The antenna assembly of claim 3 wherein:

said dipole radiator extends outside said waveguide approximately $\lambda/4$ from said open end, where $\lambda$ is the wavelength at the midband operating frequency of said antenna assembly.

5. The antenna assembly of claim 4 wherein:

said dipole radiator is comprised of first and second conducting surfaces having a separation therebetween.

6. The antenna assembly of claim 5 wherein:

said separation between said first and second conducting surfaces gradually increases as the longitudinal distance of said first and second conducting surfaces from said open end increases.

7. The antenna assembly of claim 5 wherein:

said first and second conducting surfaces are formed and disposed with respect to each other so as to form a generally horn shaped opening therebetween.

8. The antenna assembly of claim 1 wherein:

said dipole radiator extends outside said waveguide approximately $\lambda/4$ from said open end, where $\lambda$ is the wavelength at the midband operating frequency of said antenna assembly.

9. The antenna assembly of claim 8 wherein:

said dipole radiator is comprised of first and second conducting surfaces having a separation therebetween.

10. The antenna assembly of claim 9 wherein:

said separation between said first and second conducting surfaces gradually increases as the longitudinal distance of said first and second conducting surfaces from said open end increases.

11. The antenna assembly of claim 9 wherein:

said first and second conducting surfaces are formed and disposed with respect to each other so as to form a generally horn shaped opening therebetween.

12. The antenna assembly of claim 1 wherein:

said energy transition means is a single ridge tapered transition.

13. The antenna assembly of claim 1 wherein:

said energy transition means is a dual ridged tapered transition.

14. In a combined dipole antenna and waveguide assembly which includes a dipole antenna extending from an open end of a waveguide, the improvement comprising:

a slotline electromagnetic energy feed positioned within said waveguide and operably connected to said dipole antenna for directly coupling electromagnetic energy from within said waveguide to said dipole antenna.

* * * * *